United States Patent [19]

Kirchner

[11] Patent Number: 4,570,862

[45] Date of Patent: Feb. 18, 1986

[54] FLEXIBLE DISK REFINER AND METHOD

[75] Inventor: Edward C. Kirchner, Pittsfield, Mass.

[73] Assignee: Beloit Corporation, Beloit, Wis.

[21] Appl. No.: 531,274

[22] Filed: Sep. 12, 1983

[51] Int. Cl.[4] ..... B02C 7/14

[52] U.S. Cl. ..... 241/28; 241/261.2; 241/297

[58] Field of Search ..... 241/28, 161, 162, 163, 241/251, 253, 261.2, 261.3, 261, 296, 297, 298, 300, DIG. 30

[56] References Cited

U.S. PATENT DOCUMENTS 3,371,873 3/1968 Thomas ..... 241/163

*Primary Examiner*—Mark Rosenbaum

*Attorney, Agent, or Firm*—Hill, Van Santen, Steadman & Simpson

[57] ABSTRACT

A plurality of axially spaced and axially resiliently flexible annular refining disks in a refiner working chamber have stock flow equalizing ports through the disks, and the pressure on opposite sides of the disks is balanced as by pressure balancing vanes associated with the ports. The vanes may be mounted on the disks at the ports or may be carried by rotor structure and aligned with the ports.

13 Claims, 6 Drawing Figures

FLEXIBLE DISK REFINER AND METHOD

BACKGROUND OF THE INVENTION

1. Field of the Invention

This invention relates to refiners for particulate material and is more particularly concerned with paper pulp refiners equipped with resiliently flexible refining disks, and a method of refining.

2. Description of Prior Art

Conventional methods of refining paper stock, as it comes from beaters, digesters, or other pulping apparatus, generally involve passing the stock between rigid grinding or refining surfaces which break up the fibrous material and effect some further separation and physical modification of the fibers.

Substantial improvements in refiners for this purpose are disclosed in the copending application for patent of John B. Matthew and Edward C. Kirchner, Ser. No. 486,006 filed Apr. 18, 1983, assigned to the same assignee as the present application. According to that application, the rigidity constraints typically theretofore required in rotary disk refiners is overcome and substantial improvements in structure and operation are attained by the provision of resiliently flexible refining surface-supporting disks permitting operating pressure responsive adjustments of the relatively rotating refining surfaces axially relative to one another for attaining optimum material working results from the refining surfaces. More particularly, a rotor carries a plurality of the disks in axially spaced relation, and radially outer margins of the disks carry refining surface ring plates which confront and cooperate with complementary refining surfaces of a stator.

In order to maintain an orderly flow of stock to be refined through the disks, the disks have ports therethrough. In operation a large volume of paper making stock must flow through the ports. Due to mechanial strength requirements in the refining disk, these ports should be as small as possible. On the other hand, for refiner volume efficiency as great a velocity as practicable and thus flow force of paper making pulp stock must be maintained through the refiner. There may thus be a tendency toward pressure gradients through the refiner causing non-uniform refining, poor pulp development and therefore difficulty in maintaining proper web-forming control at the paper making machine in which the refined pulp is used. It is to the alleviation of such problems that the present invention is primarily directed.

SUMMARY OF THE INVENTION

An important object of the present invention is to attain as nearly as practicable uniform stock flow distribution and refiner disk stability in a refiner equipped with self-adjusting flexible refining disks.

Another object of the invention is to provide in a refiner having a flexible disk assembly a method and means for assisting in flow of the material to be refined and to alleviate detrimental pressures or force gradients.

To this end, the present invention provides apparatus especially useful for refining paper making stock and having a working chamber for transit therethrough of the stock, there being a plurality of coacting refining surfaces in part on a rotor and in part on a stator in said chamber and providing a refining zone for refining the stock in said transit, and comprising a plurality of axially spaced and axially resiliently flexible annular refining disks mounted at one of their edges on said rotor and carrying means providing refining surfaces at their opposite edges for coacting with the stator refining surfaces, stock flow equalizing ports through said disks, and means cooperatively related to said ports for balancing the pressure on opposite sides of said disks.

There is also provided by the present invention a method of refining paper making stock in transit through a working chamber providing a refining zone, comprising subjecting the paper making stock in said refining zone to the action of stator refining surfaces and cooperating refining surfaces at one of the edges of a plurality of axially spaced and axially resiliently flexible annular refining disks mounted at their opposite edges on a rotor, directing the stock through flow equalizing ports in said disks, and balancing the stock pressure on opposite sides of said disks.

BRIEF DESCRIPTION OF THE DRAWINGS

Other objects, features and advantages of the present invention will be readily apparent from the following description of representative embodiments thereof, taken in conjunction with the accompanying drawings, although variations and modifications may be effected without departing from the spirit and scope of the novel concepts embodied in the disclosure, and in which.

DETAILED DESCRIPTION

Figure 1:
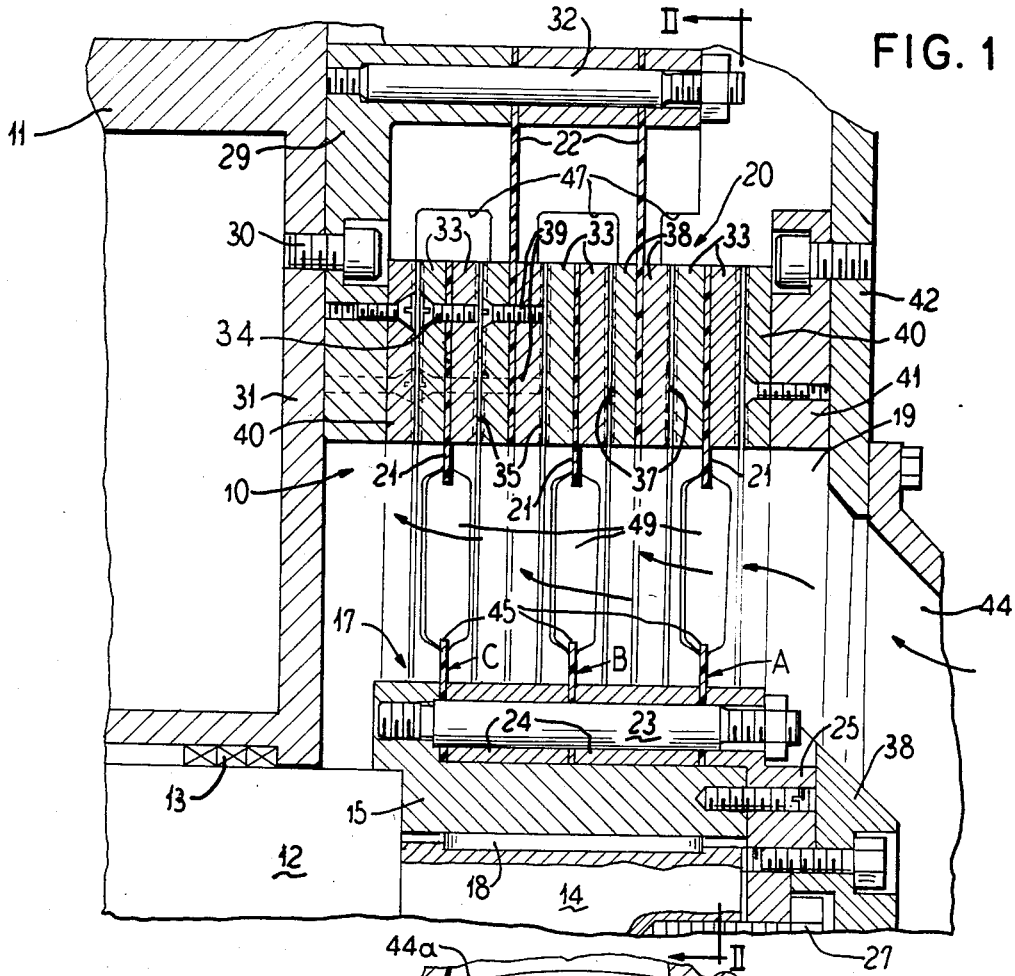
FIG. 1 is a fragmentary longitudinal sectional elevational detail view through a flexible disk pulp refiner embodying features of the invention.

A flexible disk refiner assembly 10 in which the present invention is embodied, is adapted for reducing and fibrilating various fibrous materials into individual fibers, and is particularly adapted for use in the paper making industry for refining woodpulp in preparing paper making stock. Although a single unit of the refiner assembly has been shown by way of example, it will be understood that a series of refiner assemblies according to the invention may be employed where, in the pulp refining process, the pulp fibers must be progressively reduced.

In a preferred arrangement, the assembly 10 includes a stationary chambered housing 11 in which a shaft 12 is supported for rotation on conventional bearing means including a bearing structure 13, the shaft being driven in any suitable manner as for example by means of a motor (not shown). A shaft stub 14 is provided as a coaxial extension on the free end of the shaft 12. A hub 15 for a refining rotor 17 is secured as by means of a key 18 corotatively to the stub 14. In rotation of the shaft 12, the rotor 17 is rotated within a refiner working chamber 19 defined by and within the housing 11. Mounted within the chamber 19 and cooperating with the rotor 17 is a refining stator 20. By preference, the rotor 17 comprises a plurality of resiliently flexible annular refining disks 21 which are properly longitudinally spaced in the rotor for cooperation with resiliently flexible annular stator refining disks 22 of suitably larger inside and outside diameter. In the illustrated instance, three of the rotor disks 21 cooperate in an interdigitated mode with two of the stator disks 22, and in addition with stationary refining structure of the stator, although there may be more or less of the cooperating rotor and stator disks, as may be desired.

In a preferred arrangement, the rotor disks 21 are mounted to the hub 15 in accurately longitudinally spaced relation by means at one edge, herein their radially inner edges, which receive the hub 15 therethrough. Bolts 23 and suitable spacers 24 secure the disks 21 to the hub 15. A retainer plate 25 is secured as by means of a bolt 27 to the terminal end of the stub 14, and a protective cap 28 is secured over the assembly at the stub end. Support for the stator disks 22, coaxially cooperative with the rotor disks 21, is provided by means of an annular mounting plate 29 secured as by means of screws 30 to a radially extending wall 31 defining the inner side of the chamber 19. Bolts 32 secure radially outer margins of the stator disks 21 to the mounting plate 29.

At their adjacent, spacedly interleaved margins, the stator and rotor disks have refining plate means. For this purpose, each of the rotor disks 21 carries on its radially outer margin a pair of annular refining ring plates 33, substantially narrower than the disks 21. Securement of the plates 33 to the disks 21 may be by means of screws 34. Oppositely facing refining surfaces 35 on the refining plates 33 cooperate in closely gapped relation with confronting refining surfaces 37 on adjacent annular refining ring plates 38 of the same diameter and carried by and attached to the radially inner margins of the stator disks 22. Means such as screws 39 secure the refining plates 38 in sandwiching relation to the margins of the disks 22.

At the opposite ends of the rotor 17, the endmost refining disks 21 have the refining surfaces of the endmost ring plates 33 in cooperative refining gap relation with respect to concentric, coextensive refining ring plates 40 comprising part of the stator assembly and supported by the stator support 29 at one end of the assembly and by a mounting ring 41 at the opposite end of the assembly. The mounting ring 41 is carried by a closure plate 42 secured as by means of bolts 43 (FIG. 2) to the housing 11 and defining the side of the chamber 19 opposite to the wall 31.

Pulp stock to be refined is delivered to the chamber 19 by way of an inlet 44, and enters the chamber 19 coaxially with the rotor 17 for uniformly traversing the refining zone provided by the cooperating rotor and stator refining disks, and more particularly their cooperating axially facing refining plate surfaces between which all of the stock must pass enroute to an outlet 44*a* which may extend generally radially or tangentially from the chamber 19.

To facilitate uniform stock flow and refining, the rotor disks 21 are desirably provided with openings or ports 45 therethrough and which may be of progressively larger cross-sectional flow area or size from the disk 21 nearest the inlet 44, to the disk 17 at the opposite or inner side of the chamber 19. After the stock has passed radially through the grinding, refining gaps provided cooperatively by the rotor and stator refining surfaces, the refined stock passes toward the outer circumference of the chamber 19 by way of passageway provided by radially opening ports 47 through the stator disk supporting structure, and then leaving the chamber 14 through the peripheral outlet 44*a*. Of course, if desired, the direction of refining flow of the stock to be treated may be reversed, whereby the outlet 44*a* may become the inlet and the inlet 44 may become the outlet. Also if preferred, the order of rotor and stator may be reversed, that is the rotor 17 may be constructed as a stator and the stator 20 may be constructed as a rotor, depending on preference.

By virtue of their axial resilient flexibility, the refining disks 21 and 22 are especially desirable for attaining efficient self-alignment and self-centering for uniformily of refining action between the refining surfaces of the ring plates carried by the disks. In other words, the disks 21 and 22 are responsive to dynamic fluid pressure exerted by the material traversing the refining gaps during relative rotation of the refining disks together with their refining plates. In a practical construction, where the rotor refining disks 21 are about eighteen inches in outside diameter and the stator disks 22 are about twenty-four inches in outside diameter, and the ring plates 33, 38 and 40 are of about eighteen inches outside diameter and fourteen inches inside diameter, a desirable thickness for all of the disks 21 and 22 may be about 0.070 inch where the disks are made from fiberglass. On the other hand, the refining ring plates 33, 38 and 40 may be made from stainless steel with an overall thickness of about 0.375 inch each and their refining surfaces may have ribs or bars 48 of about 0.062 height and width, and spaced apart about 0.187 inch, canted in the desired direction from the radially inner to the radially outer edges of the plates.

Although a preferred material for the refining disks 21 and 22 is fiberglass or fiberglass-epoxy composite, it may be preferred to use other materials having a high strength to modulus elasticity ratio, such as Scotchply reinforced plastic type 1002 Crossply, or other suitable materials such as spring stainless steel, or the like. Selection of material and thickness should be such that the disks are capable of axial resilient deflection, i.e., flexibility, but possessed of thorough resistance to radial and circumferential deflection, so as to effectively withstand torque and centrifugal loads in operation. As to the refining plates, although stainless steel has been mentioned, the material should be a relatively hard and relatively inflexible wear-resistant material such as nihard stainless steel, ceramic, or the like.

Figure 2:
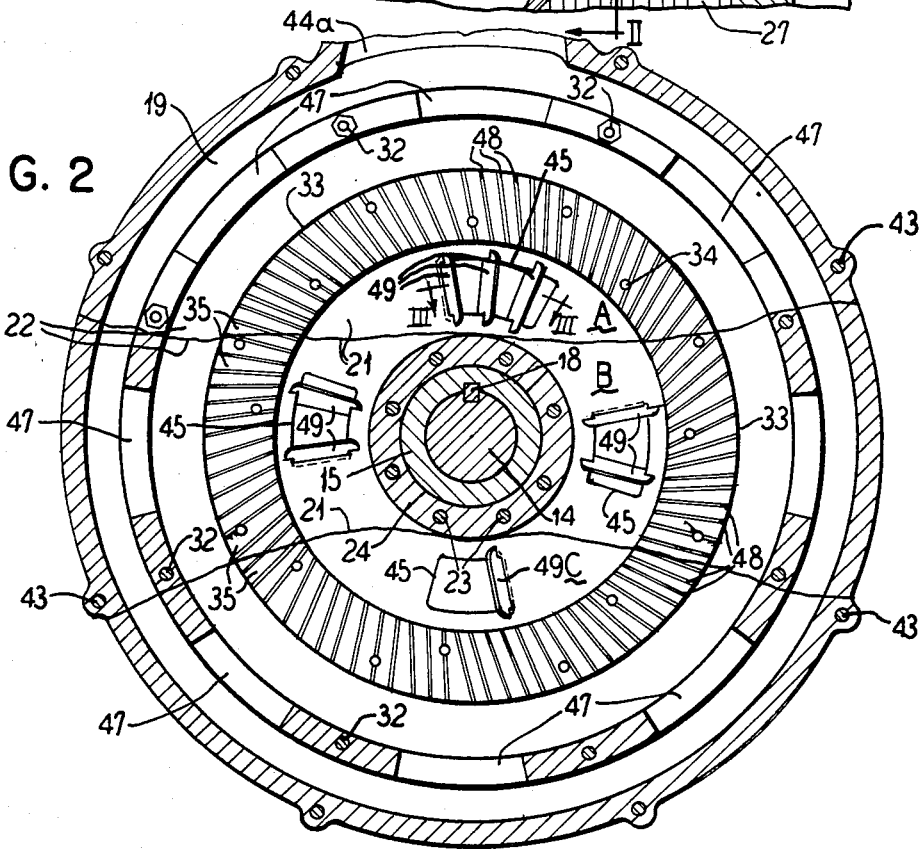
FIG. 2 is a reduced scale diametric sectional elevational view taken substantially along the line II—II in FIG. 1, but by breakaways showing certain details as though taken at staggered plane intervals.
Figure 3:
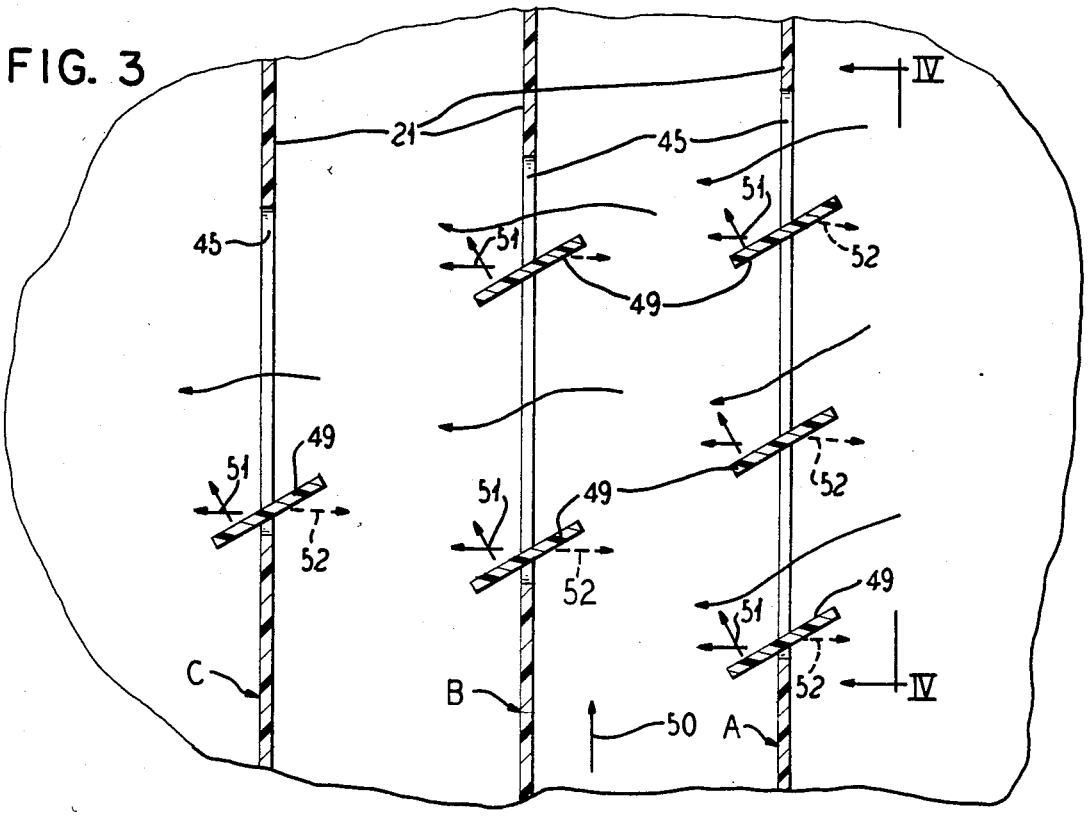
FIG. 3 is a substantially enlarged fragmentary sectional detail view taken substantially along the line III—III in FIG. 2.
Figure 4:
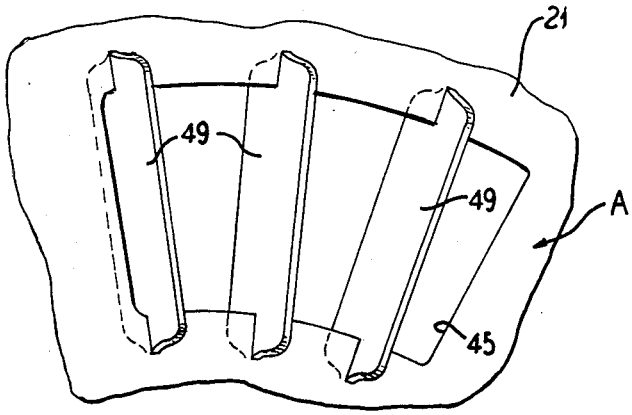
FIG. 4 is an elevational view taken in the plane of line IV—IV in FIG. 3.

As seen in FIGS. 2 and 3, the flow equalizing ports 45 through the disks 21 are designed for maximum axial flow equalizing efficiency through the rotor 17. Therefore the ports 45 of the rotor disk 21, identified as A, nearest the inlet 44 has the ports 45 therethrough of the largest cross-sectional flow area. The next disk 21, identified as B, and axially spaced from the disk A in a direction away from the inlet 44, has its ports 45 of a smaller cross-sectional flow area than the ports 45 of the disk A substantially proportionate to the increased travel distance of the flowing material from the inlet 44. For the same reason the ports 45 through the next downstream disks 21, identified as C, are of proportionately smaller cross-sectional flow area relative to the ports 45 of the disk B. In a desirable arrangement, each of the disks 21 may have four of the ports 45 therethrough disposed at 90° intervals and the ports 45 of the several disks axially aligned.

Means are provided for enhancing the handling of large volumes of stock through the refiner even though for mechanical strength requirements the ports 45 through the rotor disks 21 must be as small as practicable. Without such flow enhancing means there is a likelihood of pressure gradients developing which are detrimental to the optimum functioning of the refining disks, more particularly with respect to their self-equalizing capability by virtue of resilient flexibility. Such means desirably comprises pressure equalizing and flow enhancing fins or vanes 49 cooperatively related to the ports 45. In a desirable arrangement where there is progressive diminution in cross-sectional flow area through the ports in the disks A, B and C, a relatively proportionate number of the vanes 49 is desirably provided in respect to each of the several disks. For example, there may be provided in association with each of the ports 45 of the disk A three of the vanes 49 equally spaced in circumferential direction. Two of the vanes may be provided for each of the ports 45 in the disk B, and one of the vanes 49 for each of the ports in the disk C. Each of the vanes 49 may extend at least throughout the radial extent of the associated port 45 and may extend equally to each opposite side of the associated disk.

Each of the vanes 49 may be canted in the direction of rotation of the disks as best seen in FIG. 3 taken with the arrow 50 which indicates the direction of rotation. In this arrangement, each of the vanes has a leading edge on the upstream side of its disk and a trailing edge on the downstream side of its disk, with the leading edge directed in the direction of disk rotation. Thereby, as the disks 21 rotate in operation, the vanes 49 serve as impellers, as indicated by the arrows 51 to provide components of stock impelling force downstreamwardly through the associated port 45 as well as in the centrifugal direction toward the refining zone provided by the coacting refining plates 33 and 38 of the rotor and stator. At the same time, the fluid pressure on the advancing faces of the vanes 49 and the drag of the vanes through the fluid causes a back pressure reaction as indicated by the arrows 52 which substantially balances force vectors, so that detrimental pressure or force gradients across the disks 21 will be substantially eliminated even though large volume and velocity of the stock slurry are handled by the refiner.

For some purposes it may be desired to orient the vanes in an axial direction or in a reversely canted direction from that shown, to accommodate the characteristics of the particular stock to be handled.

Attachment of the vanes 49 may be effected in any desirable manner, depending on the material from which the disks 21 and the vanes 49 are made. In a fiberglass construction, the vanes may be cured with the disks into a functionally integral construction. Location of the vanes 49 relative to the associated ports 45 is preferably such that there is one of the vanes 49 at each of the trailing ends of the ports. Thus, in respect to the disk A one of the vanes 49 is adjacent to the trailing end of the associated port 45. A second of the vanes 49 is located at an intermediate position along the associated port 45 and the third vane 49 is located adjacent to but is substantially spaced from the leading edge of the port 45. As to the disk B one of the vanes 49 is located adjacent to the trailing edge of the associated port 45 and the second vane 49 is located in spaced relation to the first vane but also spaced from the leading end of the associated port 45. On the disks C the single vane 49 is located adjacent to the trailing end of the associated port 45.

Figure 5:
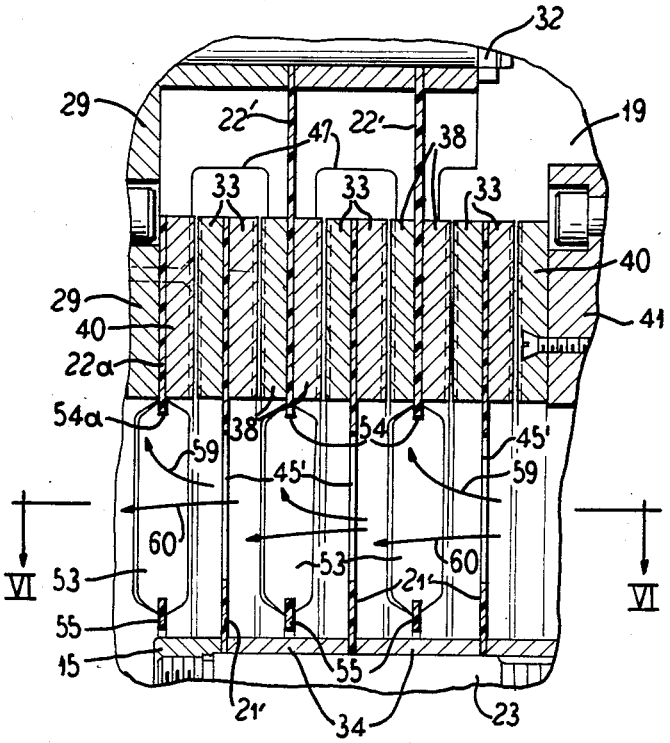
FIG. 5 is a longitudinal sectional detail view taken in substantially similar plane as FIG. 1 but showing a modification in the refining disk assembly.
Figure 6:
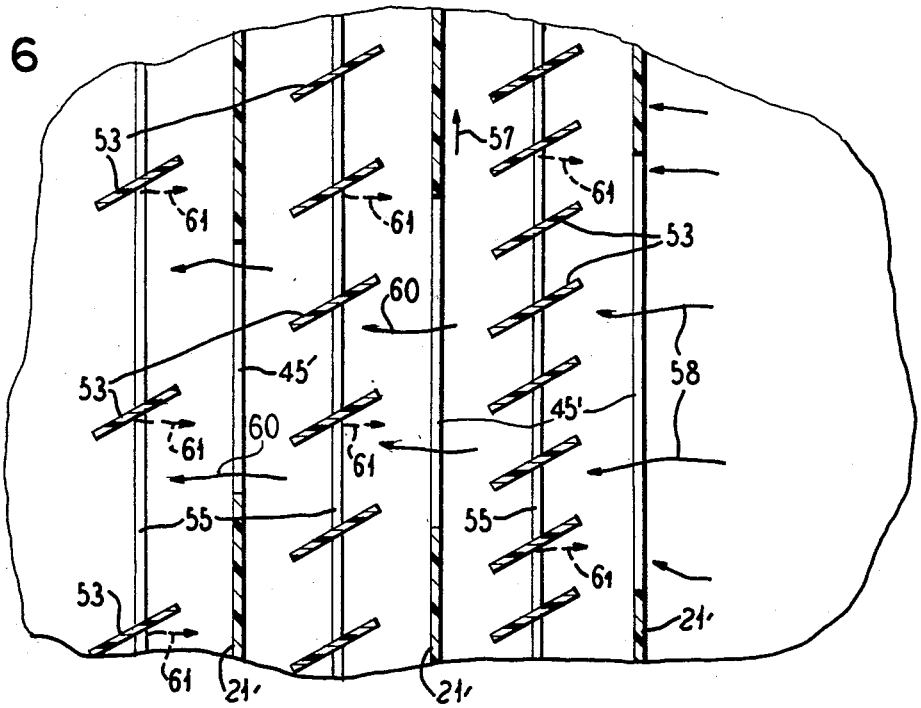
FIG. 6 is a sectional detail view taken substantially along the line VI—VI in FIG. 5.

Rather than the active pressure balancing means provided by the vanes 49 mounted on the rotor disks 21 and cooperatively related to the ports 45, an arrangement as shown in FIGS. 5 and 6 may be utilized wherein the pressure balancing means cooperatively related to ports 45', which provide for flow through the rotor disks 21', are passive radially inwardly extending and generally axially tilted vanes 53 carried by radially inward extensions 54 on the stator disks 22'. As best seen in FIG. 5, the stator disk extensions 54 extend only a limited distance inwardly from the inner diameters of the refining ring plates 38 carried by the stator disks 22' and which are in other respects the same as the disks 22 in FIG. 1. The vanes 53 are at least as long as the radial width of the ports 45' and which ports may be of the same configuration and of progressively diminishing cross-sectional flow area in the successive rotor disks 21' from the inlet side of the chamber 19 to the opposite side of the chamber as described in relation to the ports 45 in FIGS. 1–4. At their radially inner ends, each set of the vanes 53 is connected together by means of a respective ring 55, the inner diameter of which is in clearance relation to the rotor 15.

It will be observed, that by mounting the pressure balancing vanes 53 on the stator disks 22', the respective sets of vanes 53 are adapted to be equally spaced from the adjacent rotor disks 21'. Desirably the width of the vanes 53 is such that as mounted their upstream and downstream edges are about in planar alignment with the refining surfaces of the refining plates 38. The spaces between the edges of the vanes 53 and the adjacent rotor disks 21' may be about equal to the width of the adjacent rotor refining ring plates 33.

For optimum pressure balancing function, the number of the vanes 53 is greater in the set between the rotor disk 21' nearest the stock inlet into the refiner, and the vanes 53 in the succeeding sets inwardly from the first set are of progressively smaller number. In each set of the vanes 53, as best seen in FIG. 6, the vanes 53 are equally spaced in a complete circle so that in each revolution of the refiner rotor 15, there will be equal balancing of the pressure on the disks 21, even though the plurality of ports 45' are in space relation in the rotary direction in each of the rotor disks 21.

Each of the vanes 53 in each of the sets may be canted toward the upstream disk 21' in the general direction of rotation of the rotor as indicated by the directional arrow 57. Thereby, as the stock slurry to the treated travels from the inlet side of the refiner toward the nearest disk 21' and passes through the ports 45' thereof, as indicated by the directional arrows 58, and impinges the first set of the vanes 53, the material will be directed by the vanes generally radially outwardly as indicated by directional arrows 59 toward the refining gaps between the refining plates 33 and 38, and also in a downstream direction as indicated by directional arrows 60 toward and through the ports 45' in the second rotor disk 21' to repeat the flow pattern on impingement of the second set of the vanes 53, and so on through the ports 45' in the last of the disks 21' at the downstream end of the refining zone. By virtue of the stock slurry velocity and pressure, a sufficient back pressure vector, as indicated by the directional arrows 61, is generated by the vanes 53, and imposed on the downstream sides of the disks 21' to balance out pressure gradients imposed on the upstream sides of the rotor disks 21'. As a result pressures on both sides of each of the rotor disks 21' are substantially balanced so that the resiliently flexible rotor disk assemblies are adapted to function to best advantage in operation of the refiner.

*It will be understood that variations and modifications* may be effected without departing from the spirit and scope of the novel concepts of this invention. For example, although preformed vanes on the flexible disks have been disclosed as a preferred mode, other modes for accomplishing the same purpose may be utilized, e.g. portions of the disks, such as adjacent to the refining plates, may be caused to deflect and buckle during refinding torque into a symmetrical array of vane-like configurations.

I claim as my invention:

1. Apparatus especially useful for refining paper making stock, comprising:

means defining a working chamber for transit of the stock therethrough;

means defining a rotor and a stator in said chamber;

a plurality of axially spaced refining surfaces carried by said stator;

a plurality of axially spaced and axially resiliently flexible annular refining disks mounted at one of their edges on said rotor and carrying means providing refining surfaces at their opposed edges for coacting in a refining zone with the stator refining surfaces for refining the stock in transit through said working chamber and said refining zone;

stock flow equalizing ports through said disks; and vane means cooperatively related to said ports for balancing the pressure on opposite sides of said disks.

2. Apparatus according to claim 1, wherein said pressure balancing vane means are carried by said refining disks.

3. Apparatus according to claim 2, wherein said refining disks and said vanes at said ports are formed from material selected from fiberglass, fiberglass-epoxy composition or spring stainless steel.

4. Apparatus according to claim 1, wherein said pressure balancing vane means are carried by said stator.

5. Apparatus according to claim 1, wherein said pressure balancing vane means comprise a plurality of vanes canted in the direction of rotation of said rotor disks.

6. Apparatus according to claim 5, wherein said vanes are mounted on said rotor disks at said ports.

7. Apparatus according to claim 6, wherein said ports through said disks are of progressively smaller cross-sectional flow area from the disks at the upstream side of said transit to the downstream side of said transit, and said vanes being of diminishing number substantially proportionate to the decreasing cross-sectional flow area of said ports.

8. Apparatus according to claim 1, wherein said rotor comprises axially resiliently flexible annular refining disks having margins thereof interdigitated with and carrying refining surface means interdigitated cooperatively with the refining surface means on said stator refining disks, and said refining disks of said stator having extensions carrying said pressure balancing vane means in the form of pressure balancing vanes located in *spaced relation to the downstream sides of said refining* disks on the rotor.

9. Apparatus according to claim 8, wherein said vanes extend radially in axial alignment with said ports and are equally spaced in a circumferential direction, with their upstream edges canted in the direction of rotation of said refining disks on said rotor.

10. Apparatus according to claim 1, wherein said stator refining surfaces are carried on annular axially resiliently flexible refining disks equipped with said vane means, and said stator disks and said vane means being made from material selected from fiberglass, fiberglass-epoxy and spring stainless steel.

11. Apparatus according to claim 1, wherein said vane means comprise vanes carried by said disks at said ports and extending to each side of each disk and in the rotation of the disks developing in the stock flowing through said ports back pressure vectors as well as radial and axial propulsion vectors.

12. A method of refining paper making stock in transit through a working chamber providing a refining zone, comprising:

subjecting the paper making stock in said refining zone to the action of stator refining surfaces and cooperating refining surfaces at one of the edges of a plurality of axially spaced and axially resiliently flexible annular refining disks mounted at their opposite edges on a rotor;

directing the stock through flow equalizing ports in said disks in progressively smaller cross-sectional flow area from the disks at the upstream side of said transit to the downstream side of said transit; and balancing the stock pressure on opposite sides of the disks by operating vanes which are in diminishing numbers substantially proportinate to the decreasing cross-sectional flow area of said ports.

13. A method of refining paper making stock in transit through a working chamber providing a refining zone, comprising:

subjecting the paper making stock in said refining zone to the action of stator refining surfaces and cooperating refining surfaces at one of the edges of a plurality of axially spaced and axially resiliently flexible annular refining disks mounted at their opposite edges on a rotor;

directing the stock through flow equalizing ports in said disks; and balancing the stock pressure on opposite sides of said disks and developing in the stock flow through said ports back pressure vectors as well as radial and axial propulsion vectors.

* * * * *